US005152730A

United States Patent [19]

Hoffman

[11] Patent Number: 5,152,730

[45] Date of Patent: Oct. 6, 1992

[54] HANDLESS WALKING AID FOR PREVENTING FALLS FROM LOSS OF BALANCE

[76] Inventor: Roger E. Hoffman, 8380 Greensboro Dr., #321, McLean, Va. 22102

[21] Appl. No.: 709,970

[22] Filed: Jun. 4, 1991

[51] Int. Cl.[5] ..... A61H 3/04

[52] U.S. Cl. ..... 482/69; 482/68; 135/67

[58] Field of Search ..... 272/70.3; 280/87.02 W, 280/47.35; 297/6; 128/25 R; 135/67; 482/66, 67, 68, 69

[56] References Cited

U.S. PATENT DOCUMENTS

| | | | |
|---|---|---|---|
| 97,078 | 11/1869 | Goulding . | |
| 2,903,238 | 9/1959 | Flandrick | 272/70.3 |
| 3,778,052 | 12/1973 | Andow et al. | 135/67 |
| 3,993,349 | 11/1976 | Neufeld et al. | 272/70.3 |
| 4,159,110 | 6/1979 | Dodenhoff . | |
| 4,312,505 | 1/1982 | Engelhart | 272/70.3 |
| 4,342,465 | 8/1982 | Shillings | 135/67 |
| 4,463,817 | 8/1984 | Mennesson . | |
| 4,621,804 | 11/1986 | Mueller . | |
| 5,048,849 | 9/1991 | Mathews et al. | 135/67 |

FOREIGN PATENT DOCUMENTS 2004765 8/1971 Fed. Rep. of Germany .

*Primary Examiner*—Stephen R. Crow
*Attorney, Agent, or Firm*—Laurence R. Brown

[57] ABSTRACT

A walking aid comprising a movable framework mounted on wheels is provided for handicapped persons that may lose their balance when walking, so that they need not have to rely upon a companion for support when practicing walking after an injury, etc. This aid can be used while the walker is manipulating crutches or canes. The walker may easily enter the walking aid into a resident position without the necessity to climb over framework structure. It is freely moved by body contact without the use of hands on its wheel mounts. The resident walker loosely wears a harness that is removably affixed to the framework in a manner that will prevent a fall by bearing the walker's weight in an upright position, but which permits walking with little encumberment. The walking aid is moved on its wheels over the floor by means of the harness with little effort, and needs no hands for grasping or support during walking.

1 Claim, 1 Drawing Sheet

HANDLESS WALKING AID FOR PREVENTING FALLS FROM LOSS OF BALANCE

TECHNICAL FIELD

This invention relates to therapeutic walking aids for helping handicapped and injured persons walk, and more particularly it relates to apparatus for facilitating walking alone without support from a companion or therapist that eliminates the fear of losing balance and falling by elderly, injured or handicapped walkers.

BACKGROUND ART

Therapeutic walking aids are known in the prior art for supporting persons that cannot normally walk. Most of these depend upon the use of the arms to carry or share the weight of the walker usually borne by the legs. These walking aids are distinguished from wheel chairs in which a person sits or training aids for holding normal children in a walking position. However, such known prior art walking aids are not universally adaptable to conditions encountered by injured, elderly or handicapped persons who need to practice walking when a companion is not available for support.

Therapeutic walking requires extensive practice to gain more normal use of motive powers of the legs, body muscles and nervous system that may have been lost from injury, disease, strokes, old age or handicap. When full normal walking capacity is not present a walker can easily lose balance to result in bodily injury or embarrassment. Injury is more likely if a walker using crutches falls.

Some walking aids are so complicated to mount or so restricted in use that they are inconsistent with use by a person who has walking handicaps, such as those disclosed in U.S. Pat. Nos. 4,621,804, R. R. Mueller, Nov. 11, 1986 and 4,463,817, J. R. Mennesson, Aug. 7, 1984. Thus, handicapped legs and/or motive power is not consistent with the necessity to climb into a resident position in some walker aid framework configurations.

Many walking aids are not useful for a walker that may need to use crutches or canes in the process of learning or relearning to walk normally. For example, if the arms must be used for supporting body weight while walking in the walking aid configuration, that is inconsistent with the use of crutches. In the therapy of learning or re-learning to walk, it is important that the walker can walk as naturally as possible, with or without canes or crutches. That is inconsistent in general with prior art design of walking aids, where the aid itself is a crutch, which does not encourage the improvement of walking skills and the development of walking gaits, etc.

A most important factor in rehabilitation of a patient after injury or stroke is the attitude of the patient toward the therapy work. If encumbered by injury and subject to probably loss of balance while practicing walking, and the accompanying fear of injury or embarrassment, the patient may not desire to practice walking without an assistant or companion to rely upon, and recovery is more difficult.

Thus, therapeutic walking programs are often limited by the lack of a helper or companion for assisting those persons who are apt to lose their balance. Accordingly, there is a significant need for a therapeutic walking aid that can be used by a walker, without the need for a companion, that will encourage frequent practice in a prescribed therapeutic walking program.

It is therefore an object of this invention to provide an improved therapeutic walking aid that resolves the foregoing problems.

DISCLOSURE OF THE INVENTION

This invention introduces a therapeutic walking aid that permits a person to walk without obstruction or interference, even if carrying crutches, while protecting the walker against fall or injury should the walker lose his or her balance. Thus, the walking aid provides stability to handicapped persons with balance problems, and instills confidence so that they may walk by themselves without the aid of a therapist or companion.

A rolling framework is provided for moving along a floor surface along with the walker that does not require the use of the hands to push the framework or to share the body weight with the legs. Thus, the arms are left free for use of a cane or crutch, for example, or merely for swinging while walking to help maintain balance. This framework is strong enough to bear the weight of the walker should he or she lose balance and thus is configured to prevent a fall.

This is achieved by a framework resting and moving on a set of wheels. The framework positions body support bars at a height extending above the walker's legs, crotch and hip. Thus, a removable harness assembly forming an emergency seat is fastened to the support bars to be worn at a height on the particular walker that does not support any weight or form a seat unless and until the walker loses his or her balance. The harness serves as the means for moving the walking aid along the floor with the walker while leaving the hands free.

Another deficiency with prior art walking aids, namely the difficulty of a walker to enter or mount the walker structure is overcome. Those needing a walker are not usually physically able to climb over or twist to enter into a resident position in a walker aid structure, even if that inconvenience could be tolerated without discouragement. Thus, this invention provides for a walking aid structure with free access to the walker into a resident position in a walking compartment or cage.

Critical features of the framework include (1) a construction of supporting wheels that keep the framework supported without tilting with the weight of an unbalanced walker, (2) caging structure formed by the support bars close to the walker's side ion a resident walking position to leave free the space extending downwardly to a footprint pattern on the floor sufficient to permit the use of a cane or crutch by a resident walker, (3) an open access gateway for the walker to walk into resident caging structure of the walking aid so that there is no necessity to climb or twist into position, and (4) an easy to don and wear harness assembly for receiving the walker's legs and crotch in a weight supporting relationship that is removably affixed to the support bars at a critical height for the particular walker.

Further features, advantages and construction details of the therapeutic walking aid provided by this invention will be found throughout the following description, claims and the accompanying drawings.

BRIEF DESCRIPTION OF THE DRAWINGS

Throughout the several figures of the drawing like reference characters refer to similar features to facilitate comparison. In the drawings:

FIGS. 4 and 5 are front view sketches of the walking aid in use by a handicapped person requiring use of a cane or crutch.

THE PREFERRED EMBODIMENT

Figure 1:
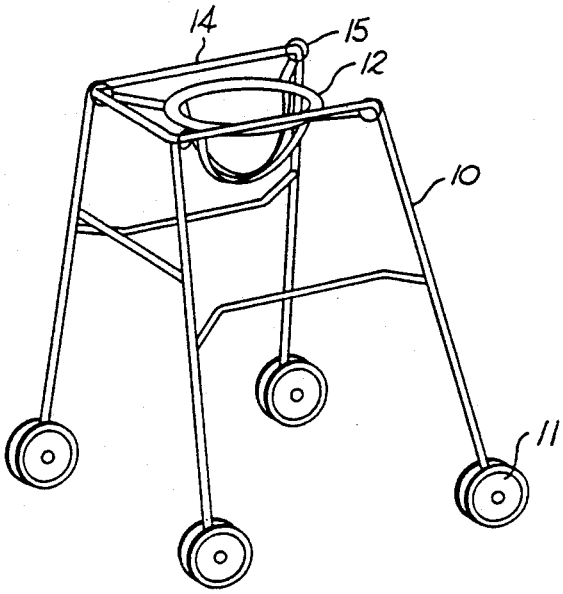
FIG. 1 is a perspective sketch of the walking aid provided by this invention.
Figure 2:
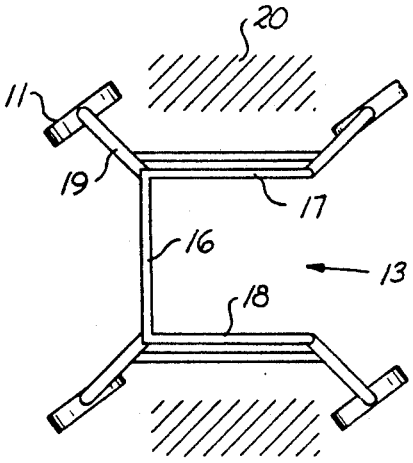
FIG. 2 is a top view sketch of the walking aid with the harness unattached.

The therapeutic walking aid of FIGS. 1 and 2 provides stability to a handicapped person with balance problems to prevent a fall. Thus, the framework 10 is moved on a support surface by means of casters or wheels 11 extending outwardly by means of arms 19 in a plurality of at least three directions a distance that prevents the framework from tipping over from the weight of a walker in residence that might become unbalanced.

Figure 5:
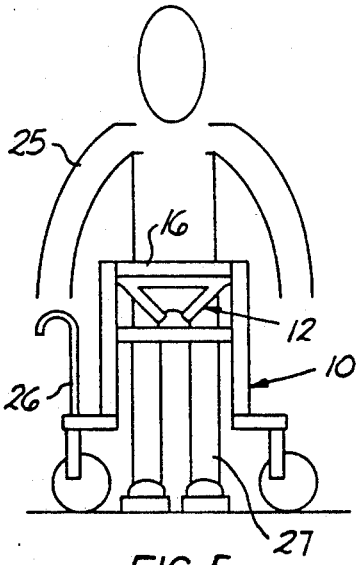
Figure 6:
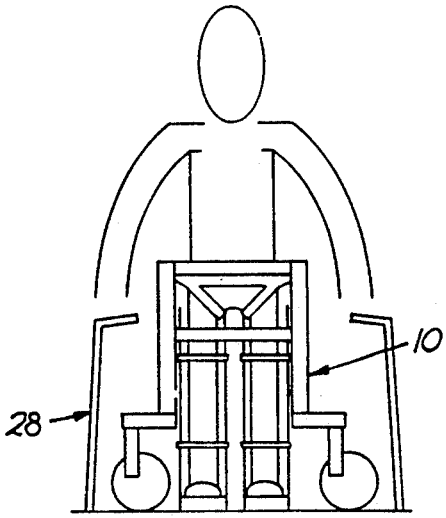

A removable harness attachment 12 is securely attached, preferably at four positions 15, in a weight bearing quick disconnect coupling, by suitable connector means not shown in detail. The height of this harness on the walker is critical, and thus adjustment of the height by means of strap length or adjustable legs of the framework is provided. Thus, in resident position the harness 12 supports no weight, but stands ready to receive the full weight of the walker as an emergency seat in the event that he or she loses balance. As a auxiliary function the harness 12 serves as the means for moving the walking aid framework 10 along with the walker, and significantly leaves the hands free for normal walking balance or use of a cane or crutches as shown in FIGS. 5 and 6. Thus, the framework needs no hand grasp members extending above the upper framework bracing cagework 14, which can be grasped by the hands to help share the walker's weight with the legs under some conditions.

In this walking aid, the removable harness is donned by the walker before entering a resident position within the caging bar configuration 16, 17, 18, which only extends on three sides of the resident walker leaving the open access entryway 13 for the walker. Thus, there is no need for contortion of the body or climbing over interfering structure, which is most difficult for many handicapped persons.

It is also critical that the caging bars 17 and 18 on leach side of the resident walker are positioned close to the body, thus to permit the walker to use the cane and crutch aids shown in FIGS. 5 and 6 in contact with the supporting surface footprint regions 200. This feature is important also without the use of crutches, etc., since it is important in therapeutic walking particularly that a normal gait be developed with the arms swinging for purpose of balance, etc. Thus, the arms are free for such action, since they are not required for support of the body or for movement of the walking aid along the floor or equivalent support surface.

Figure 3:
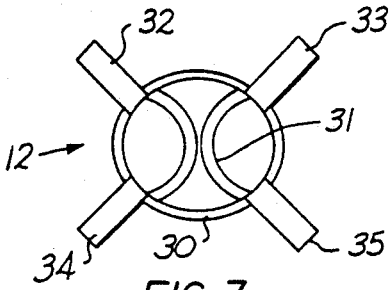
FIGS. 3 and 4 are respectively top and front view sketches of a removable harness attachment afforded by the invention.
Figure 4:
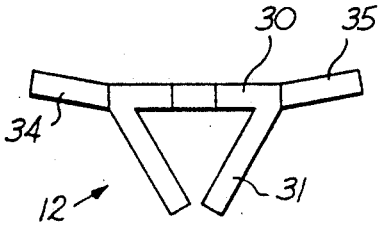

The harness 12 construction features are shown in FIGS. 3 and 4 and its relationship in a resident position to a walker is shown in FIGS. 5 and 6. Thus, a waistband 30 loosely fits about the waist or hips of a resident walker 25, with the leg straps 31 fitting loosely about each leg and resident in the crotch region. The harness 12 by means of the length of straps 32, 33, 34, 35, of a height adjustment for the supporting cage bars 16, etc., is held in a position so that no weight is borne when the resident walker 25 is normally walking with weight on the legs with the framework 10 following, but is secured as an emergency cradle or seat for catching the walker 25 if he or she stumbles or loses balance to prevent a fall. The straps of the harness may be of canvass, nylon web, or the like. The weight bearing connectors may be buckles held by the straps 32, 33, 34, 35 and associated retaining means on the framework, or interconnecting clips, connectors and the like well known in the art.

It is evident that this novel walking aid provides a new and improved method of therapeutic treatment of handicapped and injured persons in the practice of walking in the aforesaid manner, which gives a patient confidence and the opportunity to practice without the requirement of an assistant or comrade for support. The framework members may be made of steel, aluminum or reinforced plastic rods or tubes.

Having therefore advanced the state of the art in walking aids and therapeutic treatment of the handicapped, those features of novelty descriptive of the nature and spirit of this invention are set forth with particularity in the following claims.

I claim:

1. A therapeutic walking aid for accompanying handicapped persons attempting normal walking to provide balance support to prevent falls so that they may walk without a supporting companion in attendance, comprising in combination, a framework for moving on a supporting surface along with a walking person by movement of a walker in residence therein, said framework having horizontal top weight bearing members positioned at substantially waist height extending above a walker's legs and crotch and hip to define caging bars extending in front of and on both sides of the walker with bracing to support the bars for bearing the walker's weight upon loss of balance and further having an unrestricted open rear entryway extending downwardly to the supporting surface so that the walker may enter and leave a position within the framework without need to climb over or under any framework structure, a harness seat assembly for receiving the walker's legs and crotch in a non-weight bearing relationship for walking without the use of hands and adapted for emergency weight bearing use as a supporting seat if a walker loses balance, interacting attachment means for securing the harness assembly to the framework at a non-weight bearing height for permitting the walker to walk freely with weight on the legs, with said harness serving to move the framework on the support surface while providing an emergency weight supporting cradle seat for the walker for preventing the walker from falling upon loss of balance when the legs do not fully support the weight of the walker, and a wheel mount carrying supporting wheels for rolling the framework on the supporting surface, wherein said caging bars comprise lateral bracing structure extending laterally from a walker's resident position to extend said supporting wheels in a plurality of at least three directions a distance for providing a supporting foundation that prevents the framework from tipping from the weight of an unbalanced resident walker, said wheel mount and caging bar structure on two sides configured close to the walker's leg when in a resident position, and configured to permit the walker to use manually cane and crutch aids on the supporting surface outside the caging bars on the sides of the walker without interference with the walking aid when the person is walking.

* * * * *